US005652958A

United States Patent [19]

Farrell-Mestas

[11] Patent Number: 5,652,958

[45] Date of Patent: Aug. 5, 1997

[54] NURSING CANOPY FOR USE BY A NURSING MOTHER

[76] Inventor: Eileen F. Farrell-Mestas, 5513 Chimney Swift Dr., Wake Forest, N.C. 27587

[21] Appl. No.: 630,360

[22] Filed: Apr. 10, 1996

Related U.S. Application Data

[63] Continuation-in-part of Ser. No. 771,245, Oct. 4, 1991, abandoned.

[51] Int. Cl.[6] ..... A41D 1/00; A41D 1/20; A41D 1/22

[52] U.S. Cl. ..... 2/48; 2/104; 2/49.1

[58] Field of Search ..... 2/88, 104, 48, 2/49.1, 49.2, 49.4, 51, 52

[56] References Cited

U.S. PATENT DOCUMENTS

| | | | |
|---|---|---|---|
| D. 315,705 | 3/1991 | Smith . | |
| D. 322,709 | 12/1991 | Keola . | |
| 4,631,754 | 12/1986 | Ryan | 2/104 |
| 4,987,612 | 1/1991 | Middleton | 2/104 |
| 4,989,268 | 2/1991 | Stolhand | 2/52 X |
| 5,012,543 | 5/1991 | Lewis, Sr. . | |
| 5,259,068 | 11/1993 | Carroll | 2/88 X |
| 5,469,582 | 11/1995 | Livingston | 2/49.1 X |
| 5,479,662 | 1/1996 | Runco | 2/104 |
| 5,544,364 | 8/1996 | Weber | 2/51 X |

*Primary Examiner*—C. D. Crowder
*Assistant Examiner*—Shirra L. Jenkins
*Attorney, Agent, or Firm*—Adams Law Firm, P.A.

[57] ABSTRACT

A nursing canopy is provided for use by a nursing mother to protect the modesty of the mother when breast feeding an infant. The nursing canopy includes a fabric panel having a dimension sufficient to cover the front of the mother from the neck to the waist. A strap is attached to the panel for extending around the back of the neck to suspend the panel from the neck. A self-supporting neckline flange is located along a perimeter portion of the panel, and defines a self-supporting neckline of the panel. The neckline flange cooperates with the strap to hold the neckline of the panel a spaced-apart distance from a front neck area of the mother, thus defining an open viewing area such that the mother is capable of readily viewing the feeding infant.

5 Claims, 2 Drawing Sheets

NURSING CANOPY FOR USE BY A NURSING MOTHER

TECHNICAL FIELD AND BACKGROUND OF THE INVENTION

This application is a continuation-in-part of U.S. Ser. No. 791,245, filed on Oct. 4, 1991, now abandoned.

The invention relates to a nursing canopy for use by a nursing mother. The invention is intended to protect the modesty of the mother when breast feeding her infant in public areas. The self-supporting neckline of the invention allows the mother to handle the infant with both hands while maintaining eye contact with the infant. The infant can be continuously monitored, thus instilling security, confidence, and relaxation in the mother.

One prior art nursing canopy is disclosed in U.S. Pat. Des. No. 322,709. The neckline of this canopy sags downwardly against the upper chest of the mother, and does not provide an open viewing area for permitting the mother to readily view and monitor the nursing infant. Instead, according to the '709 patent, the mother would be required to use one or both hands to lift the neckline of the canopy outwardly away from her body while simultaneously handling the infant.

The present invention addresses this and other problems of the prior art by providing a nursing canopy with a self-supporting neckline that naturally extends outwardly from the front neck area of the mother during wear. The mother is thus capable of viewing and handling the nursing infant without also attempting to hold the neckline of the canopy away from her body.

SUMMARY OF THE INVENTION

Therefore, it is an object of the invention to provide a canopy for a nursing mother which includes a self-supporting neckline.

It is another object of the invention to provide a canopy for a nursing mother which protects the modesty of the mother when breast feeding her infant in public areas.

It is another object of the invention to provide a canopy for a nursing mother which promotes security, confidence, and relaxation of the mother.

It is another object of the invention to provide a canopy for a nursing mother which allows the mother to handle the infant with both hands while maintaining eye contact with the infant.

These and other objects of the present invention are achieved in the preferred embodiments disclosed below by providing a nursing canopy for use by a nursing mother to protect the modesty of the mother when breast feeding an infant. The nursing canopy includes a fabric panel having a dimension sufficient to cover the front of the mother from the neck to the waist. A strap is attached to the panel for extending around the back of the neck to suspend the panel from the neck. A self-supporting neckline flange is located along a perimeter portion of the panel, and defines a self-supporting neckline of the panel. The neckline flange cooperates with the strap to hold the neckline a spaced-apart distance from a front neck area of the mother, thus defining an open viewing area such that the mother is capable of readily viewing the feeding infant.

According to one preferred embodiment of the invention, the neckline flange extends generally perpendicularly to a major surface of the panel when laid in a substantially flat condition.

According to another preferred embodiment of the invention, the strap includes a fastener member located at a free end thereof for attaching the free end to the panel.

According to yet another preferred embodiment of the invention, a second, complementary fastener member is located adjacent to the neckline flange on a second major surface of the panel for mating with the first fastener member of the strap.

According to yet another preferred embodiment of the invention, the first and second fastener members are respective hook and loop fasteners.

An embodiment of the method according to the invention comprises the steps of attaching a nursing canopy around the neck of a nursing mother for protecting the modesty of the mother when breast feeding an infant. The canopy is provided with a self-supporting neckline extending outwardly from a front neck area of the mother to define an open viewing area such that the infant is readily viewed by the mother when breast feeding.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
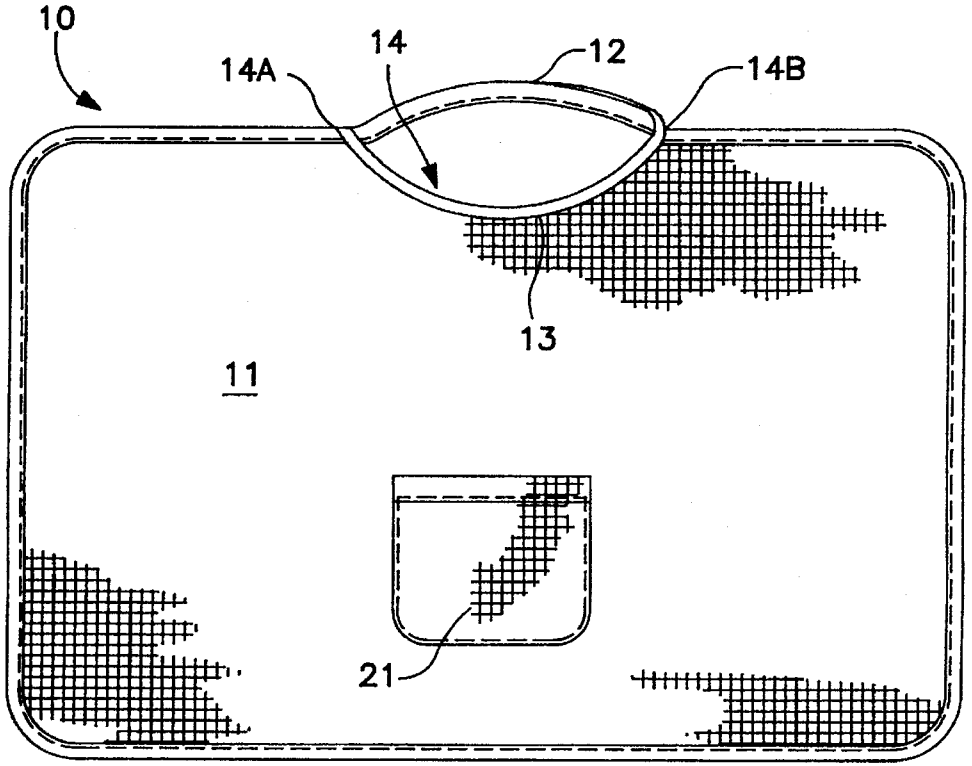
FIG. 1 is a front view of the nursing canopy according to one preferred embodiment of the invention, and showing the fabric panel of the canopy in a substantially flat condition.

Referring now specifically to the drawings, a nursing canopy according to the present invention is illustrated in FIG. 1 and shown generally at reference numeral 10. The nursing canopy 10 is used by a nursing mother to protect the modesty of the mother when breast feeding her infant in public areas.

The nursing canopy 10 includes a fabric panel 11 having a dimension sufficient to cover the front of the mother from the neck to the waist. The panel 11 is preferably formed of 100% cotton, or other desired knit or woven fabric material. A strap 12 is attached to a top edge of the panel 11, and is secured around the back of the neck of the mother to suspend the panel 11 from the neck. A self-supporting neckline flange 13 is located at the neckline 14 of the panel 11 and extends from a point 14A to a point 14B of the neckline 14. A free end 12A of the strap 12 is preferably removably attached to the panel 11 adjacent to the neckline flange 13 using complementary hoop and loop fasteners 16 and 17. Alternatively, each end of the strap 12 is permanently attached to the panel 11 by sewing or other means.

Figure 5:
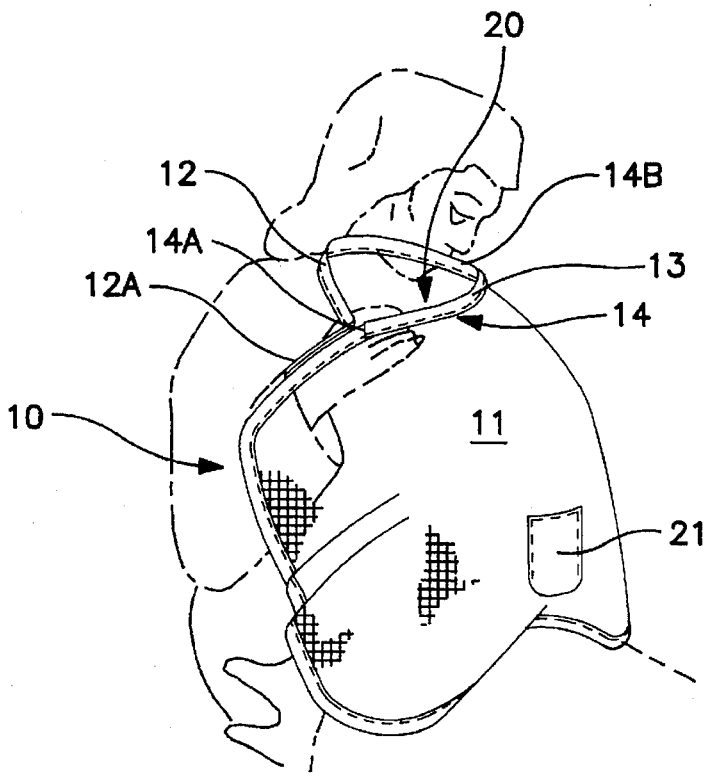
FIG. 5 is a front side perspective view of the canopy as worn by a mother.

As shown in FIG. 5, the neckline flange 13 cooperates with the strap 12 to hold the neckline 14 of the panel 11 a spaced-apart distance from the front neck area of the mother. This defines an open viewing area 20 through which the mother is capable of readily viewing the feeding infant without uncovering and exposing the infant or herself. According to one embodiment, the neckline flange 13 is reinforced with a flexible support member, such as a thin strip of bone material, to further support the neckline 14 in spaced-apart relation to the front neck area of the mother.

Figure 3:
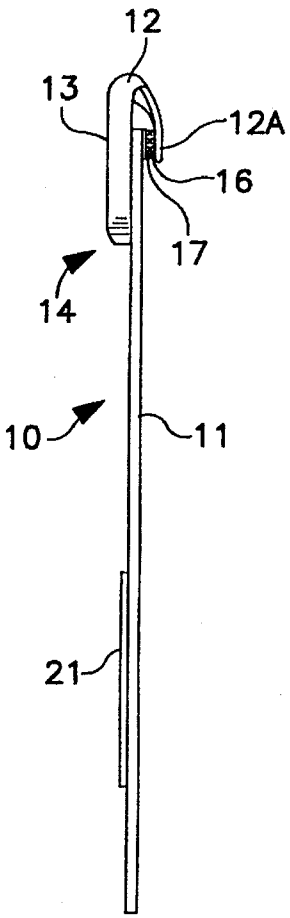
FIG. 3 is a side view of the canopy with the fabric panel laid substantially flat.
Figure 2:
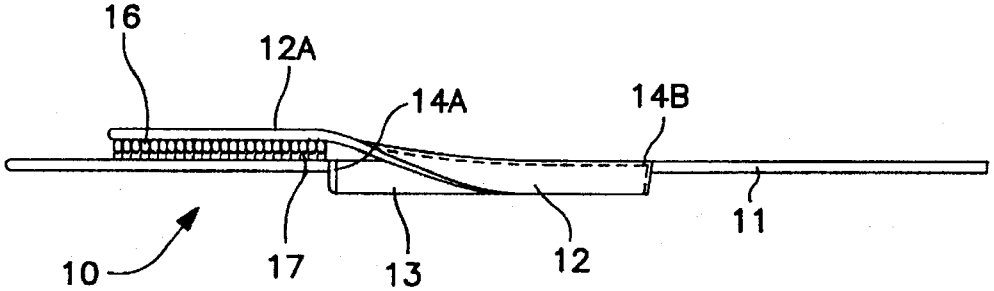
FIG. 2 is a top end view of the canopy with the fabric panel laid substantially flat.
Figure 4:
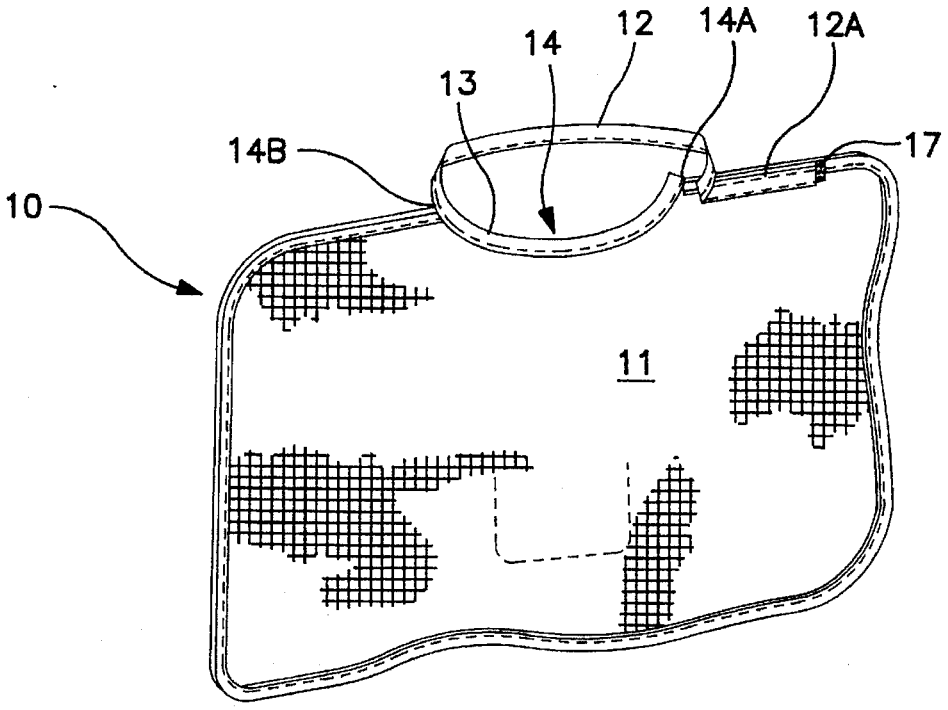
FIG. 4 is a back side perspective view of the canopy.

Alternatively, the neckline flange 13 is simply formed of an additional or separate fabric material. As best shown in FIGS. 2 and 3, the neckline flange 13 extends generally perpendicularly to the front surface of the panel 11 when laid in a substantially flat condition. In addition, the canopy 10 further includes a pocket 21 attached to the front of the panel 11 for carrying items, such as a pacifier, burping pad, and the like.

A nursing canopy is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. A nursing canopy for use by a nursing mother to protect the modesty of the mother when breast feeding an infant, said nursing canopy comprising:

(a) a fabric panel having a dimension sufficient to cover the front of the mother from the neck to the waist;

(b) a strap attached to a top edge of said panel for extending around a back of the neck to suspend the panel therefrom;

(c) a neckline flange located along a perimeter portion of said panel and extending perpendicularly outwardly from the panel when laid in a flat condition, said flange defining a contoured neckline of said panel when the canopy is worn by the mother; and (d) said neckline flange cooperating with said strap to hold the neckline of said panel a spaced-apart distance from a front neck area of the mother, and thereby define an open viewing area through which the mother is capable of readily viewing the feeding infant.

2. A nursing canopy according to claim 1, wherein said strap includes a fastener member located at a free end thereof for attaching the free end to said panel.

3. A nursing canopy according to claim 2, and comprising a second, complementary fastener member located adjacent to said neckline flange on a second major surface of said panel for mating with the first fastener member of said strap.

4. A canopy according to claim 3, wherein said first and second fastener members comprise respective hook and loop fasteners.

5. A method of protecting the modesty of a nursing mother when breast feeding an infant, said method comprising the steps of:

(a) attaching a nursing canopy around the neck of the mother; and (b) providing the nursing canopy with a neckline flange extending perpendicularly outwardly from the panel when laid in a flat condition for holding a neckline of the canopy outwardly from a front neck area of the mother to define an open viewing area through which the infant is readily viewed by the mother when breast feeding.

* * * * *